United States Patent [19]

Naber

[11] Patent Number: 4,509,284

[45] Date of Patent: Apr. 9, 1985

[54] SHOTGUN SPEED LOADER

[76] Inventor: James R. Naber, Rt. #4, Box 60, Muscatine, Iowa 52761

[21] Appl. No.: 487,534

[22] Filed: Apr. 22, 1983

[51] Int. Cl.[3] ..... F42B 39/06; F41C 27/00

[52] U.S. Cl. ..... 42/87

[58] Field of Search ..... 42/87, 88

[56] References Cited

U.S. PATENT DOCUMENTS

| | | | |
|---|---|---|---|
| 211,691 | 1/1879 | Bennett | 42/87 |
| 391,811 | 10/1888 | Mixter | 42/87 |
| 619,848 | 2/1899 | Sparrow | 42/87 |
| 1,023,489 | 4/1912 | Altick | 42/87 |
| 1,874,408 | 8/1932 | Zichy | 42/87 |
| 2,773,325 | 12/1956 | Hill | 42/87 |
| 2,866,289 | 12/1958 | Wilcox | 42/87 |
| 3,956,844 | 5/1976 | Misevich et al. | 42/87 |
| 3,986,286 | 10/1976 | Stangel | 42/87 |
| 3,991,501 | 11/1976 | Larsson | 42/88 |
| 4,322,907 | 4/1982 | Rowe | 42/88 |

OTHER PUBLICATIONS

Shooting Times; Jan. 1983, p. 76.

"The World's Fighting Shotguns", by T. F. Swearengen, published by Chesa Limited, (Title Page and Verso, 17, 300, 454, 455, 499).

*Primary Examiner*—Charles T. Jordan

*Attorney, Agent, or Firm*—Henderson & Sturm

[57] ABSTRACT

The shotgun speed loader relates to devices employed for storing shells and depositing same into a magazine. Improved efficiency and speed of loading shotgun shells is achieved by a loader (11) having a flexible tube wall (16), with slot (18), which snugly holds the shells but which rapidly discharges them upon movement of a plunger (14) having a handle (28) traveling within the slot to expand the tube wall.

5 Claims, 6 Drawing Figures

Fig. 1
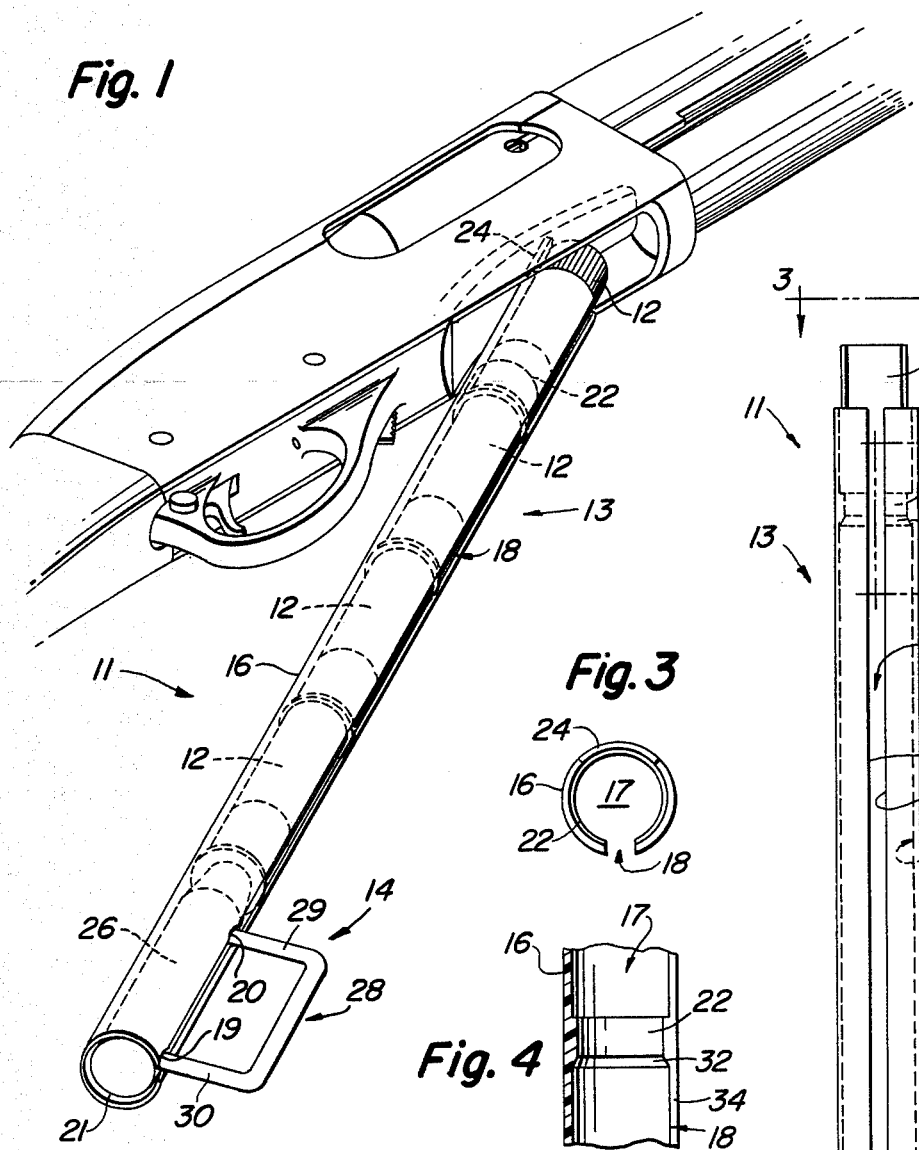
Fig. 3
Fig. 4
Fig. 5
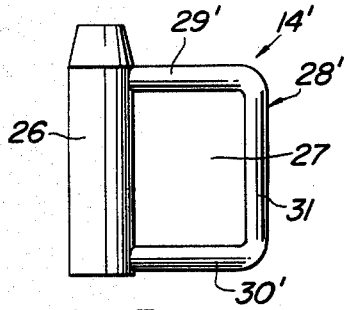
Fig. 6
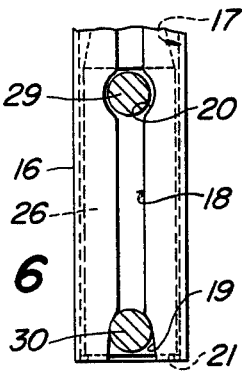
Fig. 2
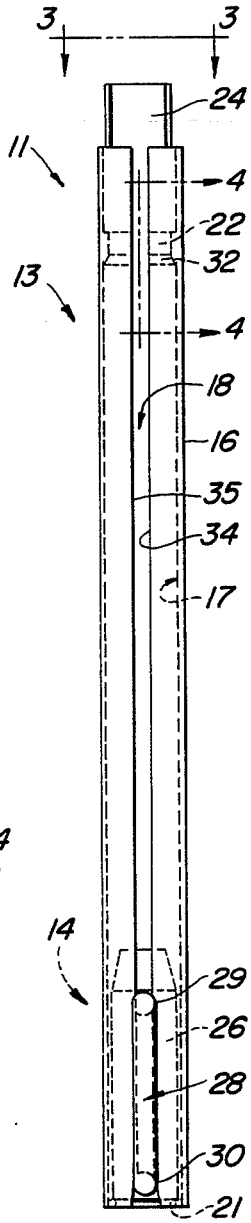

SHOTGUN SPEED LOADER

TECHNICAL FIELD

This invention relates generally to loading cartridges into weapons. More particularly the invention is concerned with apparatus for facilitating speedy loading of shells into shotguns.

BACKGROUND ART

A number of devices have been developed for holding cartridges and depositing same into revolvers and rifles.

Referring first to revolvers, there is a wheel device which holds six cartridges and deposits them into the revolver's rotating chambered block. Another device includes six cylinders, disposed in hexagonal, parallel relationship, which loads cartridges in groups of six.

Turning next to rifles, an elongated tube with plunger has been devised for holding several cartridges and shoving them into the rifle's magazine.

The foregoing devices are not designed for use with shotguns. Furthermore, the structures thereof generally are complex and cumbersome.

DISCLOSURE OF INVENTION

Responding to the needs described above, this invention provides a shotgun speed loader having an elongated tube assembly for holding a plurality of shells. An elongated slot is formed the length of the tube, and a plunger is disposed within the tube, the plunger's handle projecting through the slot. When the plunger is moved along the length of the tube, the handle travels within the slot, forcing the tube to expand, thereby permitting the shells to be shoved rapidly from the tube into the shotgun's magazine.

An object of this invention is to provide an improved structure for storing shells and loading same into a gun.

Another object of this invention is to provide an improved device for rapidly loading shells into a gun.

A more particular object is the provision of a device which facilitates rapid loading of a shotgun.

It is also an object to develop a clip for shotgun shells which is readily carried, not cumbersome or inconvenient to use, and which facilitates maintenance of a rapid rate of shotgun fire.

Yet another object is provision of a rapid loader employable with most automatic or pump shotguns without the need of special adapters for, or the provision of special loading parts or alterations to, those shotguns.

Still another object is provision of a rapid loader readily operable in a variety of orientations so as to be more adaptable to the varieties of shotguns.

Also an object is the provision of a rapid loader which is relatively simple in construction, easily fabricated and maintained, and durable yet capable of attaining the aforementioned objectives.

These objects and other features and advantages of the loader invention will become readily apparent upon referring to the following description in conjunction with the appended drawing.

BRIEF DESCRIPTION OF THE DRAWING

The shotgun speed loader invention is illustrated in the drawings wherein:

FIG. 1 is a fragmentary, perspective view showing use of the shotgun speed loader;

FIG. 2 is a top plan view of the loader;

FIG. 3 is an enlarged, end elevational view along line 3—3 in FIG. 2, of the tube assembly;

FIG. 4 is an enlarged, fragmentary, vertical section of the tube assembly along line 4—4 in FIG. 2;

FIG. 5 is a side elevational view of an alternate plunger assembly; and

FIG. 6 is an enlarged, fragmentary plan view of the loader with part of the plunger cut away.

BEST MODE FOR CARRYING OUT THE INVENTION

The shotgun speed loader of the invention is shown generally at 11 in FIG. 1 holding a plurality of shotgun shells 12. The loader 11 more particularly includes a tube assembly 13 and plunger assembly 14.

The tube assembly 13 (FIG. 2) includes an elongated, flexible tube wall 16 generally circular and annular in cross section, forming a central storage column space 17 for the shells 12. An elongated slot 18 is cut through the wall 16 and extends from end to end of, and parallel to the longitudinal axis of, the assembly 13. The slot 18 has an enlarged area 19 at the rear of assembly 13 and another such area 20 somewhat forward from area 19. In the alternative, the entire slot portion extending from area 19 to area 20 can be enlarged as well.

At the rear end of assembly 13, the interior surface of wall 16 forms a substantially annular projection or lip 21 which extends into the column space 17. Adjacent the front end of assembly 13, a substantially annular shoulder area 22 (FIG. 4) also projects from the interior surface of wall 16 into space 17. In the alternative, a pair of projections, each disposed on the interior surface of wall 16, adjacent to one of the walls 34,35, and projecting into space 17, can be employed.

An elongated finger 24 is contiguous with, and projects beyond the front end of, the tube wall 16. As seen in FIG. 3, the finger 24 in cross-section is arcuate, extending along approximately one-third of the circumference generally defined by the front end of the wall 16. The finger 24 generally extends from the area of wall 16 disposed opposite that of the slot 18.

The plunger assembly 14 (FIG. 1) includes a body member 26 having the same generally cylindrical shape as the shells 12. A U-shaped handle 28 has front and rear legs 29,30 connected to the body 26. An alternate plunger assembly 14' is shown at FIG. 5. The handle 28' includes a flat, relatively thinner web 27 and a U-shaped peripheral, relatively thicker or wider rim 31. The handle 28' is fixed to the body 26, and the rim 31 includes front and rear rim portions 29',30'. Written information can be formed on the web 27.

Use of the loader 11 is shown in FIG. 1. The example of a loader for a four-shot, 12 gauge shotgun has been illustrated. The plunger assembly 14 is disposed in the holding position at the rear of the tube assembly 13 and four shells 12 are stored. In the holding position handle leg 29 projects through slot enlargement 20 and leg 30 through enlargement 19 (FIG. 6). The fit of the legs 29,30 and enlargements 19,20 is a snug one. The cartridge case of the first shell 12 butts against the front end of the plunger body 26. The next two shells 12 are disposed in end to end fashion, cases toward the plunger 14; and all of the first three shells 12 are enclosed by the tube wall 16. The fourth shell 12 projects beyond the front end of wall 16 and is disposed against finger 24. The annular rear flange of the cartridge casing of this fourth shell 12 engages the inwardly disposed edge 32 of shoulder 22.

The loader 11 as shown in FIG. 1 can be grasped by the handle 28 and carried, or it can be attached to the user's belt or the like by straps or other structures not shown herein. During such time the shells 12 and plunger 14 do not move because of the snug fit of the handle legs 29,30 in the slot enlargements 19,20, the action of rear lip 21 against the plunger body 26, and the action of the shoulder edge 32 against the cartridge casing flange of the fourth shell 12.

To load a shotgun, the loader 11 is disposed such that the front end thereof is adjacent the entrance to the magazine of the shotgun. If there is a spring loaded plate or the like normally closing the entrance, the finger 24 is employed against the plate to open the entrance. Grasping the handle 28, the operator moves the plunger 14 toward the front end of the tube assembly 13. The handle legs 29,30 move out of the enlargements 19,20 and into the slot 18 proper. Because the slot 18 width is less than the cross section dimension of the legs 29,30, the side walls 34,35 of the slot 18 are forced apart, the flexible tube wall 16 thereby expanding such that the storage column space 17 has a larger transverse dimension. The plunger body 26 is forced against the first shell 12, and the shells 12 move within the space 17. Because the wall 16 is expanded, the shells 12 can slide up edge 32, over the shoulder 22, out the front end of the loader 11, and past the finger 24 into the shotgun magazine. The loading of the shotgun, therefore, is effected by one swift hand motion of the operator.

To place the shells 12 initially into the loader 11, the plunger 14 is disposed such that the handle legs 29, 30 project through the slot 18 proper thereby expanding the tube wall 16. Shells 12 can be dropped into the loader 11, as they will slide by the shoulder 22 and along the space 17 into abutment with the plunger body 26 or previously inserted shell 12. When the last shell 12 is inserted, a push will cause the plunger 14 to slide to the rear such that the shell 12 engages shoulder edge 32, and the legs 29,30 snap into the enlargements 19,20, whereby the tube wall 16 again conforms snugly about the shells 12.

The tube assembly 13 preferably is formed from a flexible plastic by shaping and cutting methods well known to those skilled in the plastic arts. An assembly 13 formed from polyethylene or nylon has been found to be satisfactory. The plunger assembly 14 also may be formed from plastic although a light metal may be employed for the handle 28.

The loader 11, even with a full complement of shells 12, is lightweight and easily carried. The loader 11 does not have a multiplicity of parts and is formed and cleaned easily.

The loader 11 can be positioned in many orientations with respect to the shotgun and the loading part thereof; therefore, it can be employed with optimum results with a great variety of shotguns. Satisfactory performance has been obtained, for example, with the Remington 870 Pump, The Ithica Mod. 37, the Browning A-5 Automatic, the Mossberg Pump, the Winchester Mod. 97 Pump, Winchester 12, 1200 and Remington 1100.

The loader 11 will operate to load the shotgun upon a single, rapid arm movement of the operator. It can be seen that the loading is very quick, and the shotgun can be fired, therefore, at a high rate. The advantages for military, and for certain police usages, are believed to be evident.

The industrial applicability of this shotgun speed loader is believed to be apparent from the foregoing description. Although a preferred embodiment has been disclosed herein, it is to be remembered that various alternate constructions can be made thereto without departing from the scope of this invention.

I claim:

1. A shotgun speed loader comprising:

flexible wall means defining a column space for receiving at least one shell, and defining a storage position connected with said column space;

plunger means connected to said flexible wall means, positionable at said storage position whereby said flexible wall means fits around and holds said plunger means and the shell, and movable from said storage position to spread apart said flexible wall means and to push the shell, thereby effecting rapid discharge of the shell from said column space;

slot means is formed in said flexible wall means, and an enlarged area is formed in said slot means and defines said storage position; and said plunger means includes a plunger body and a handle joined to said plunger body, said handle engaged by said enlarged area when said plunger means is at said storage position, said handle movable in said slot means, and said plunger body movable in said column space, when said plunger means is moved from said storage position.

2. The loader of claim 1 and further wherein shoulder means for engaging a shell is formed on said flexible wall means and projects into said column space.

3. The loader of claim 1 and further wherein lip means, for retaining said plunger means, is formed on said flexible wall means and projects into said column space.

4. The loader of claim 1 and further wherein finger means extends from one end of said flexible wall means.

5. The loader of claim 1 and further wherein said handle includes a web and rim means attached to said web.

* * * * *